US006693530B1

(12) United States Patent
Dowens et al.

(10) Patent No.: US 6,693,530 B1
(45) Date of Patent: Feb. 17, 2004

(54) HOME SECURITY ADMINISTRATION PLATFORM

(75) Inventors: Jac P. Dowens, Red Bank, NJ (US); Cynthia L. Spudic, Atlantic Highlands, NJ (US)

(73) Assignee: AT&T Corp., New York, NY (US)

( * ) Notice: Subject to any disclaimer, the term of this patent is extended or adjusted under 35 U.S.C. 154(b) by 105 days.

(21) Appl. No.: 09/978,153

(22) Filed: Oct. 16, 2001

(51) Int. Cl.[7] ..... G08B 29/00
(52) U.S. Cl. ..... 340/506; 340/523; 340/541
(58) Field of Search ..... 340/541, 521, 340/506, 531, 539.16, 539.26, 523; 713/200; 345/173; 379/49, 106

(56) References Cited

U.S. PATENT DOCUMENTS 4,641,127 A * 2/1987 Hogan et al. ..... 340/521
5,650,800 A * 7/1997 Benson ..... 345/173
6,356,192 B1 * 3/2002 Menard et al. ..... 340/506
6,400,265 B1 * 6/2002 Saylor et al. ..... 340/531

* cited by examiner

*Primary Examiner*—Van Trieu

(57) ABSTRACT

A network may receiving tracking information of various emergency services personnel, so that when a security breach has occurred at a particular location, the network may receive a surveillance profile from a computer that is disposed at the location where the detector is located, and dispatch the most geographically appropriate emergency services personnel as determined based on the tracking information. A verification protocol may be initiated by calling a predetermined sequence of telephone numbers set by the subscriber to the security system. If the subscriber provides the predetermined authorization code, the detected security breach is disregarded as being a false alarm. However, if the call recipient is unable to provide the predetermined authorization code, or if there is no answer at any of the numbers in the predetermined call sequence, the emergency services personnel are dispatched.

20 Claims, 4 Drawing Sheets

HOME SECURITY ADMINISTRATION PLATFORM

FIELD OF THE INVENTION

The invention relates to home security systems, including the detecting of security and safety breaches, remote monitoring thereof, and the dispatching of the proper authorities in response to a security and/or safety breach.

BACKGROUND OF THE INVENTION

Many security systems include multiple video cameras, motion detectors, heat sensors, as well as various door and window traps that have been placed in a building structure by a security company or security system vendor. Such a building structure may include, but is in no way limited to, houses, apartment buildings, hotels, office buildings, and stores. The video cameras, motion detectors, heat sensors, and door and window traps, which may be referred to generally as "security equipment", may be monitored by personnel of the security company who are located at a central station.

That is, as shown in the example of FIG. 4, a security system may include security equipment 405, shown generically, which may include video cameras, motion detectors, heat sensors and door and window traps that are disposed throughout a building structure 400, which may include either of a residence or a place of business. The present description will refer to a residence, though there are very minor differences, if any, between a security system for a residence and any of the other exemplary building structures mentioned above, and therefore the terms may be used interchangeably for the purposes of the present invention.

In the residence 400 of FIG. 4, the security equipment 405 is connected, via a telecommunications network 415, to a central station 420 of the security system provider where security system personnel 425 monitor the individual residential security systems.

Thus, if a security breach is detected, such as a break-in, burglary or fire, in addition to triggering a local alarm to alert the occupants of the security breach, the security equipment 405 transmits an alarm signal to the security system central station 420 via the telecommunications network 415. The detection signal that is received by the security system central station 420, and that is monitored by the security company personnel 425, includes an indication of whether the security breach is a break-in or fire. Further, in the event of a break-in, the detection signal may further indicate the "zone" in which the break-in has occurred. That is, the detection signal may indicate in which room or location the break-in has occurred, and may even further indicate which door or window has been detected as being breached.

At the security system central station 420, the monitoring personnel 425 may then begin a verification protocol, which may include calling a telephone line 410 at the residence 400 from which the alarm originated. This "call-back" enables the occupant to provide a predetermined personal security code, thereby assisting the security monitoring personnel 425 in determining whether an actual security breach has occurred or whether the security equipment has triggered a false alarm. In the event of a false alarm, then the security breach alarm received at the security system central station 420 is disregarded.

In the event that there is no answer at the residence from which the alarm originated, or an incorrect security code is provided in response to the call back, the security system monitoring personnel 425 may then dispatch the local authorities, or emergency services EMS 430, relative to the geographic location of the residence from which the alarm originated, and then continue the verification protocol. That is, in the event that the received detection signal indicates a break-in, the security system monitoring personnel 425 will dispatch the police department for the jurisdiction of the residence from which the alarm originated, and in the event that the received detection signal indicates a fire, the security monitoring personnel will dispatch the fire department for the jurisdiction of the residence from which the alarm originated. The verification protocol continues whereby the security monitoring personnel continue attempts to reach the owner of the residence by calling a sequence of telephone numbers that have been predetermined. The predetermined sequence of telephone numbers may include in no set order, but in no way limited to, the owner's cell phone, place of business, or even a friend or relative's phone number. The security company monitoring personnel will exhaust the telephone numbers in the predetermined sequence, even though the authorities have already been dispatched.

However, due to a variety of reasons, including the intense pressure that may accompany the job, security system monitoring personnel often forego the verification protocol and proceed immediately to dispatching the local authorities, including either the local police department or fire department. As a result, police and firefighting personnel have been dispatched in response to false alarms, thus squandering civic resources and needlessly placing citizens in peril who are in actual need of such services. There is even a further cost, whereby actual emergency situations may go unattended if emergency services have been previously dispatched to a false alarm that has not been properly canceled. The increase in false alarms incurs a financial cost to both the residential owner who must pay a civil penalty for false alarms over a predetermined threshold (three, for example) within a one-year period and to taxpayers in general who bear the burden of mis-allocated resources.

Further aggravating the situation, often times the monitoring security service personnel dispatch the improper authorities, whereby police have been dispatched for a fire emergency or a local fire department dispatched for a police emergency. Further still, many instances have occurred in which police or firefighting personnel from the wrong jurisdiction have been dispatched, thus compromising the response time to an actually emergency situation.

At least as far as the security companies, or security service vendors, are concerned, many dissatisfied customers respond to the exemplary shortcomings described above by canceling their residential security services or by switching their residential security provider.

SUMMARY OF THE INVENTION

Therefore, the present invention provides a novel network method for administrating a security system for residences and places of business which substantially eliminates the errors and delays in response times described above that are associated with most present-day security systems. In particular, the present invention provides a network-based administration of security systems by eliminating the respective security company monitoring stations and implementing a network, having a security platform, that works in cooperation with home computers for respective residences and places of business. That is, the network has multiple security platforms, and each security platform is scalable to accommodate multiple security system vendors. Further, each security platform implements an intelligent database.

In an example embodiment of the present invention, the platform corresponding to a respective security system vendor may receive tracking information for various emergency services personnel, including police and fire fighting personnel, either as the individual personnel register their locations with the network while on duty or by tracking the individual personnel using positioning technology including, but not limited to, GPS (global positioning system). The tracking information may even include registration information for the headquarters for local police departments, fire departments and emergency medical services, i.e., paramedics.

When a security breach, which may include, but is not limited to, a break-in or a fire, has occurred at a residence or place of business that subscribes to the services of the respective security system vendor, the security platform may receive a surveillance profile from a computer that is disposed at the residence or place of business at which the security breach has been detected. The computer serves as a database for all video cameras, motion detectors, heat detectors, window and door traps and any other security equipment located on the premises of the respective residence or place of business, and stores therein a surveillance profile for all local security equipment. Thus, when a security breach is detected, a detection signal is transmitted from the respective security equipment to the computer, and is then further transmitted, by network interface device (NID), to the network and the security platform.

The surveillance profile may include, but is not limited to, the type of sensor, registration information of the individual sensor, which may pertain to its address, location within the residence or place of business, and a physical description or layout of the premises in which the sensor is located. The type of sensor may include, but is not limited to, a video camera, a motion detector, a heat detector, and window or door trap. Most alarms received from the individual motion and heat detectors will also be accompanied by picture images provided by corresponding security video cameras.

After receiving the surveillance profiles from the computer on behalf of the security equipment that has detected a security breach, a verification protocol may be initiated. However, unlike conventional security system monitoring systems as described above, the present invention eliminates a security company central station, thus substantially eliminating human error which is a predominant cause of false alarms and the dispatching of inappropriate emergency services personnel. In particular, the intelligent database at the security platform may implement a subscriber verification protocol by calling a predetermined telephone number that has been previously submitted by the subscriber to the respective security system vendor. This predetermined telephone number may be supplemented, or even replaced by, an electronic-mail (e-mail) message to an internet protocol (IP) address corresponding to the computer that has initially reported the detected security breach. The subscriber verification telephone call or e-mail may include an automated request for a predetermined security code. A voice recognition program in the security platform may receive a verbal response to the automated request, and the intelligent database at the security platform may then compare the received response against the predetermined security code, which is stored in the intelligent database at the security platform. Similarly, an e-mail response to the automated response may be compared against the predetermined security code at the intelligent database. Upon receiving the predetermined security code, the intelligent database may deem the security breach to have been inadvertent, or a "false alarm", and thereby terminate all emergency protocol. However, if there is no response to the automated request for the predetermined security code, or if the party responding to the automated request is unable or even unwilling to provide the predetermined security code, then the database may then transmit the security breach information to the proper authorities, to thereby dispatch the appropriate emergency services personnel.

The subscriber verification protocol described above is more appropriate for burglary, or break-in, emergencies. That is, most security systems, including the present invention, may disregard the verification protocol for detected fire emergencies since time is of the essence in such actual emergencies. However, for both break-in type and fire emergencies, after the appropriate emergency services personnel have been dispatched, the intelligent database at the security platform of the present invention may then implement a notification protocol. The notification protocol may include the intelligent database at the security platform calling a predetermined sequence of telephone numbers, which may be supplemented or even replaced by an automated e-mail message to at least one IP address, which have been submitted to the security system in advance by the subscriber to the security system. The calls, or automated e-mail messages, may proceed until either a designated party is reached or the sequence of calls has been exhausted. An answering party, or even answering machine or service, to such automated telephone calls may receive an automated message that includes the time of the emergency at the corresponding address, and further include the type of emergency and a notification that the proper emergency services personnel have been dispatched and the time of such dispatch.

The step of dispatching of the appropriate emergency services personnel may include the intelligent database at the security platform finding corresponding emergency services personnel to respond to the detected security breach. The appropriate emergency services personnel, including those from a local police department or fire department in the jurisdiction of the residence or place of business in which the security breach has occurred, are those whose tracking information matches the address that is included in the received surveillance profile. Then, the intelligent database at the security platform may instruct the network to route a call to the matched emergency services personnel.

Thus, the present invention utilizes a smart network to administer security systems for residences and places of business that substantially eliminate false alarms and dispatches the most appropriate personnel for expeditiously responding to detected security breaches.

BRIEF DESCRIPTION OF THE DRAWINGS

The foregoing and a better understanding of the present invention will become apparent from the following detailed description of example embodiments and the claims when read in connection with the accompanying drawings, all forming a part of the disclosure of this invention. While the foregoing and following written disclosure focus on disclosing example embodiments of this invention, it should be clearly understood that the same is by way of illustration and example only and the invention is not limited thereto. The spirit and scope of the present invention are limited only by the terms of the appended claims.

DETAILED DESCRIPTION OF THE INVENTION

Figure 1:
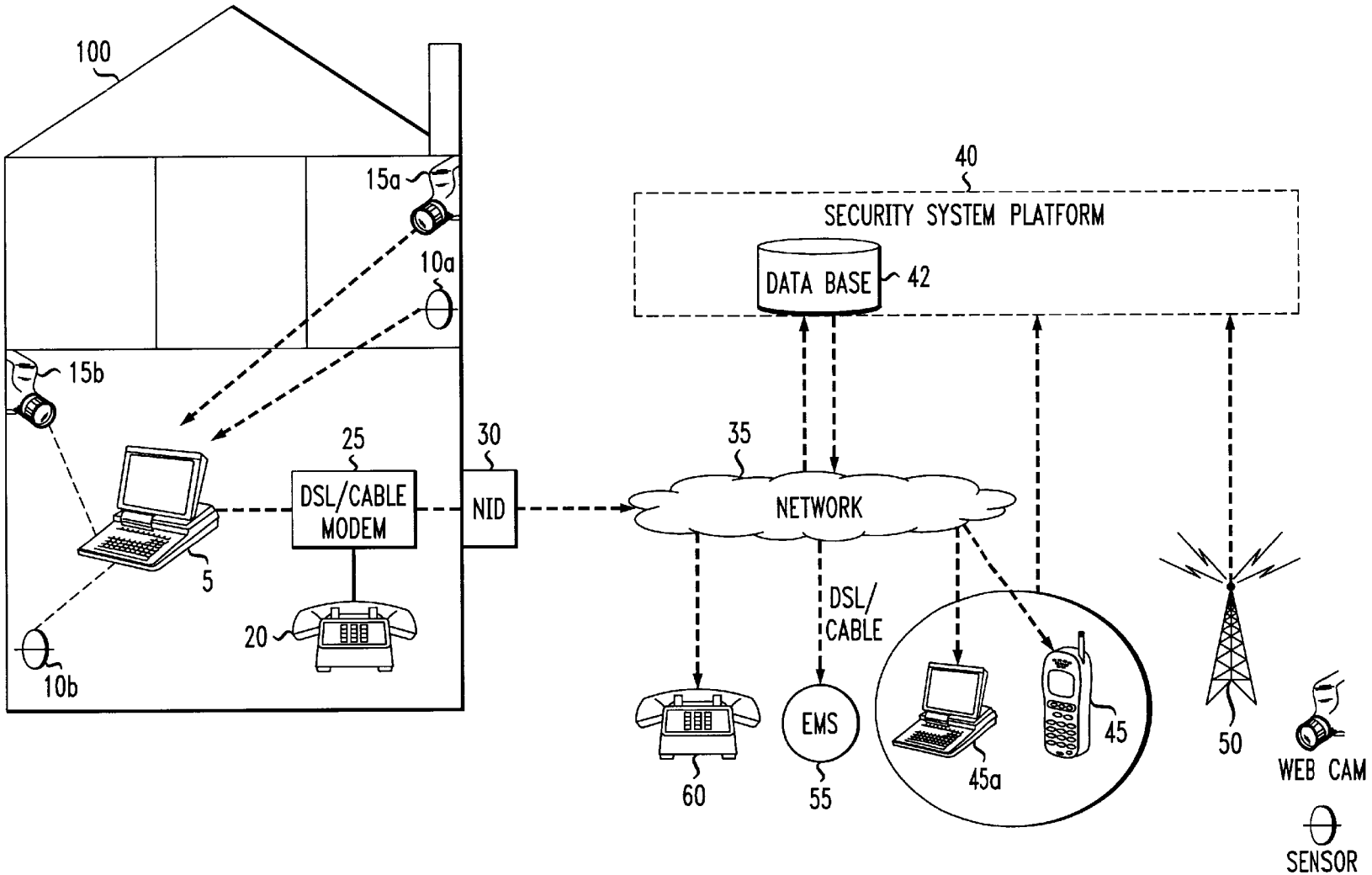
FIG. 1 shows a schematic diagram of a security system according to an example embodiment of the present invention.

Before beginning a detailed description of the invention, it should be noted that, when appropriate, like reference numerals and characters may be used to designate identical, corresponding or similar components in differing figure drawings. Further, in the detailed description to follow, example embodiments and values may be given, although the present invention is not limited thereto.

FIG. 1 shows an example embodiment of the present invention, including a home security system and network administrator. The security system is located in a building structure 100, which may interchangeably be a residence or a place of business. Though for the sake of the present description, reference will be made to residence 100.

A home security system 1 may be located in residence 100 and include a computer 5; detectors 10*a* and 10*b*, which may include motion detectors and heat sensors; security video cameras 15*a* and 15*b*; and network interface device (NID) 30, as well as various window and door traps (not shown). The security cameras 15, detectors 10, as well as the door and window traps, may be more generically referred to, at times, as "security equipment" since they are the more visible features of a residential security system, and they are what physically detects a breach, or threat, to security in the residence 100.

Further, the security cameras 15 and the detectors 10*a* and 10*b*, as well as the window and door traps, of which there is no limit of the quantity thereof within a given residence, may have a registered surveillance profile within the memory of the local computer 5. That is, all security equipment may have a respective serial number and location registered in the local computer 5. The location may include the wing, floor, and room in which the equipment is respectively located.

Further still, particularly with regard to the detectors 10, the registered surveillance profiles for the respective security equipment may also include a physical description of the room in which the equipment is located. For example, the registered surveillance profile of the respective security equipment may indicate that a detector is located in the hobby room that is on the second floor in the east wing of the residence, wherein paint supplies are stored in the closet. Such information, which may be provided to emergency services personnel, including the local fire department, as will be described further below, may be crucial in planning to react to a fire emergency, since the layout and contents, such as hazardous materials, of a room may pose special problems, including toxic fumes, the threat of explosion and/or increased temperatures.

In addition, the local computer 5 may receive a constant stream of video images from each of the video security cameras 15, whereby such video images are stored in a temporary memory. At the time of a detected security breach, as described further below, the received video images may be time-stamped and transmitted to a security system network.

The residential security system may further include a NID 30, which may provide the local computer 5 with a broadband, always-on connection to security system network 35. Within the residence 100, the local computer may be connected to the NID 30 via a digital subscriber loop (DSL) or cable model connection 25. The NID 30 may also connect the telephone line 20 within the residence 100 to the local exchange carrier (LEC) (not shown).

Furthermore, administering a security system in the event of an emergency, as described below, requires the preliminary steps of a user pre-registering a sequence of telephone numbers, which may also include a list of IP addresses for e-mail notification, that are to be called in the event of an emergency. These telephone numbers may include numbers at which the occupant(s) of a residence 100 may be reached or the numbers at which friends or relatives of the occupant (s) may be reached in the event of the occupant's absence at the time of the detected security breach.

The administration of the security system may be performed by a combination of the network 35, which may be referred to as an ATM (asynchronous transfer mode) backbone, and the security system platform 40, which is on the network 35 and includes an intelligent database 42. The network 35 may include multiple security system platforms 40, and each platform is scalable to accommodate multiple security system vendors.

Figure 2:
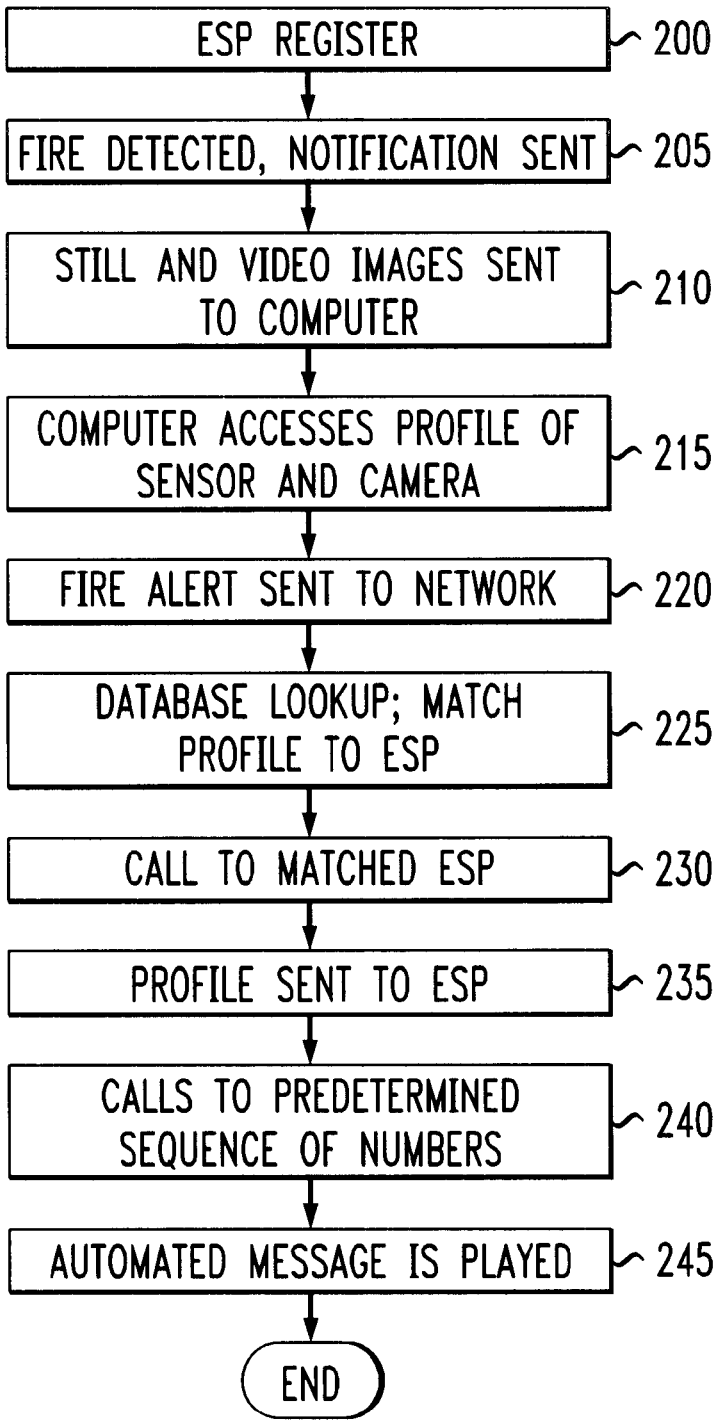
FIG. 2 shows an example of flow chart processing for the example embodiment of the present invention.

The example embodiment of FIG. 1 will be further explained in the context of a fire emergency, following the flow chart processing of FIG. 2, though neither the example embodiment nor the present invention is limited in any way to the following example description. Further, for the purposes of the present invention, it is submitted that an understanding of the operation of heat sensors would be known to one of ordinary skill in the art, and therefore such description is not included in the disclosure of the present invention.

As shown in conjunction with FIG. 2, the administration of a security system in the event of an emergency may include a first step 200 in which emergency services personnel may register their location with the security system platform 40 using a communication device 45. Step 200 may include, as examples, a policeman using a handheld or otherwise mobile terminal 45 to register the geographical parameters of her patrol, or a firehouse registering a change of personnel using a local terminal, which may otherwise be referred to as a personal computer (PC) 45*a*. Step 200 may further include a satellite-based tracking system 50, including GPS, that may register the location of its personnel who are handling a mobile terminal 45. For implementation of the present invention, mobile terminal 45 may include, as examples only, a digital/cellular/packet device, a laptop computer, or a portable digital assistant (PDA).

In the event of a fire emergency in the residence 100, for example, step 205 may include heat sensor 10*a* detecting an increase of heat, indicative of a fire, in the room that heat sensor 10*a* and security video camera 15*a* are located. The heat sensor 10*a* may then send a fire detection signal to the computer 5, further in step 205, either by wired connection in the residence 100*a* or by a wireless connection (not shown), which may also include a bluetooth connection. Step 210, which may also occur simultaneously with step 205, may include the computer 5 capturing still and video images of the room from video security camera 15*a*, which is in the same room as the detecting sensor 10*a*, whereby the still and video images are time-stamped at the time that the detection signal was received at the computer 5 from the heat sensor 10*a*.

Upon receiving the fire detection signal from the heat sensor 10*a*, the computer 5 may then, in step 215, access the surveillance profile of sensor 10*a* that has been stored therein, which may indicate, for example, that sensor 10*a* is a heat sensor that is located on the second floor in the third room to the right beneath the chimney, as shown in the example of FIG. 1, and may further describe the layout and/or contents of the room.

The computer 5 may then transmit the alarm signal originating from sensor 10*a*, the corresponding surveillance profile and the captured and time-stamped still and video images over the DSL/cable modem connection 25 to the NID 30, in step 220, which may then transmit both the alarm signal and surveillance profile to the security platform 40 on the network 35. The intelligent database 42 at the security system platform 40 may store the registration information, and therefore step 225 may include a database lookup to match the received surveillance profile of all security equipment in residence 100, all of which includes the street address of residence 100, with the nearest available fire department, which was registered in step 200.

Step 230 may include the security system platform 40 initiating an automated call from the intelligent database 42 to the matched fire department by calling the registered terminal 45 and/or another appropriate emergency medical services 55. Such call to terminals 45 and/or 55 may be implemented by the intelligent database 42 routing the transmission to a corresponding registered IP address. It is noted that the connection to the terminals 45 and/or 55 may include a DSL, cable, or other broadband connection.

The automated network call to the fire department, at step 235, may include the surveillance profile, which includes, for example, the street address of the residence 100, the room location of the detecting sensor 10*a*, still and video images from the security video camera 15*a*, and even the physical layout of the room in which the sensor 10*a* and security video camera 15*a* are located.

Once the proper emergency services personnel, in this case the local fire department, have been dispatched to the fire emergency at residence 100, the intelligent database 42 at the security system platform 40 may then begin a protocol to contact the occupant(s) of residence 100 to either verify the emergency or notify them of the emergency. Thus, in step 240, the intelligent database 42 may place automated calls to the home telephone number 20 for verification of the fire emergency. If there is no answer at telephone number 20, a sequence of telephone numbers that have been pre-registered in the intelligent database 42 at the security system platform 40 by the security system subscriber for the residence 100, may be automatically dialed until either an answer is received or the list of telephone numbers is exhausted without an answer. Upon receiving an answer, an automated message may be played to the answering party, as in step 245. The automated message, stored in a database at the security system platform 40, may indicate, for example, the type of emergency that was detected, the address of the residence, and the time that the emergency was detected.

The network protocol is similar in the event of a break-in/burglary in residence 100. In the following description, the security breach will be referred to as a "break-in", though the description is applicable to burglary and any other unlawful entry into the internal or even external premises of residence 100. Further, the description will continue to make reference to FIG. 1, as well as the flow chart of FIG. 3. In the following description, the sensors 10*a* and 10*b*, which are not limited in quantity, will be referred to as "motion detectors" 10*a* and 10*b*, since heat sensors and motion detectors may be located in close proximity to each other or even be integrated in single units of security equipment, though the present invention is not directed towards the implementation thereof. It is noted that a break-in in accordance with the following description may also be detected by various window and door traps (not shown).

Figure 3:
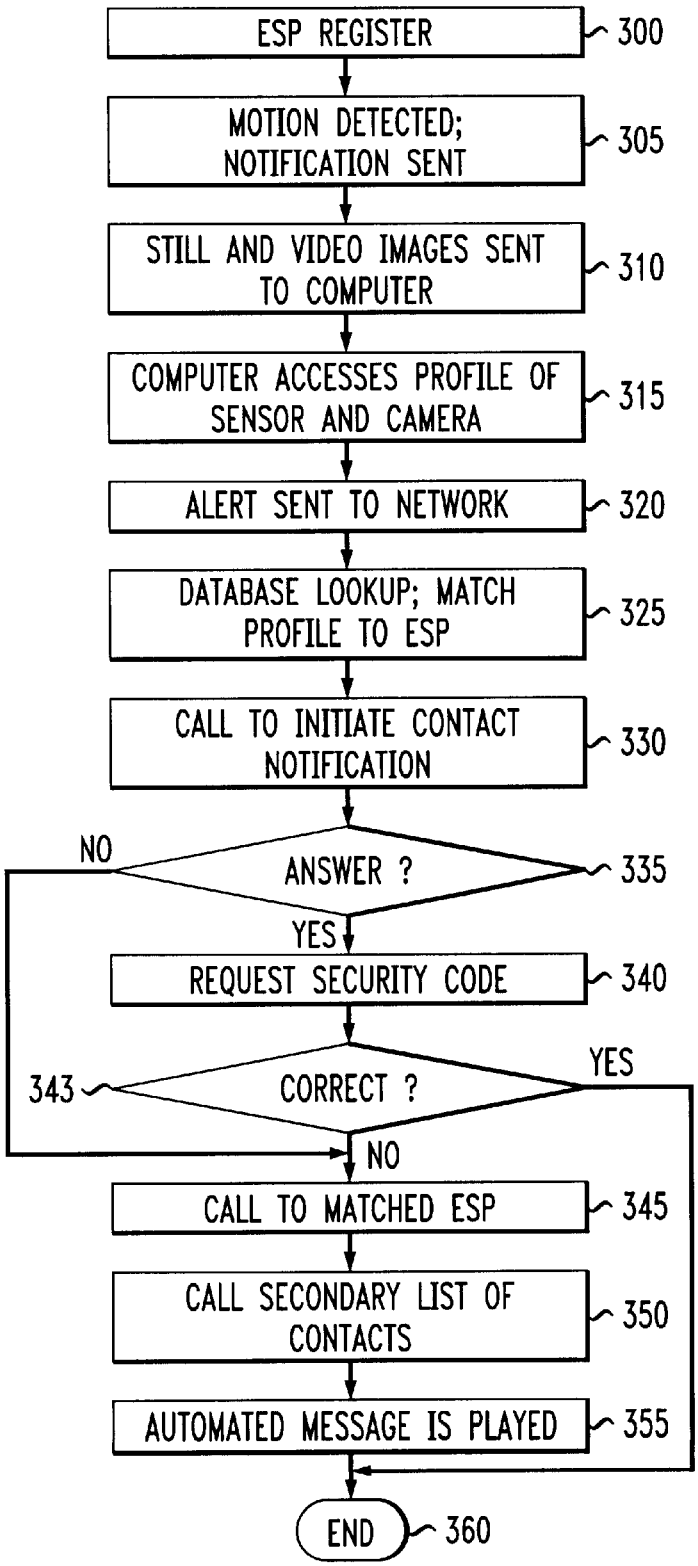
FIG. 3 shows another example of flow chart processing according to another example embodiment of the present invention.
Figure 4:
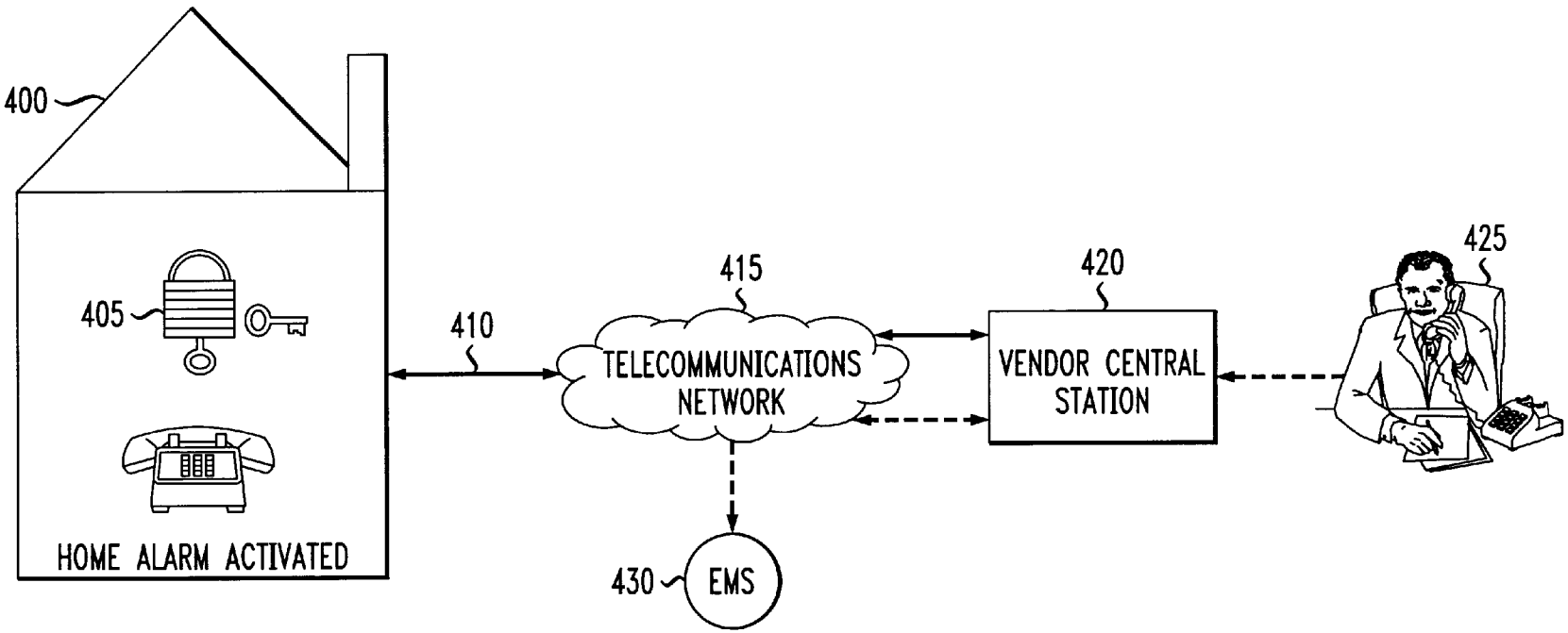
FIG. 4 PRIOR ART
FIG. 4 shows a prior art security system.

As shown in FIG. 3, a first step 300 may include the emergency services personnel, which may include police or even private security, registering their respective locations with the security system network platform 40 using a communication device 45. As set forth above with regards to step 200, step 300 may also include, as examples, a policeman using a handheld or otherwise mobile terminal 45 to register the geographical parameters of her patrol, or even a police precinct registering a change of personnel using a local terminal PC 45*a*. For implementation of the present invention, mobile terminal 45 may include, as examples only, a digital/cellular/packet device, a laptop computer, or a portable digital assistant (PDA). For the purposes of the present invention, it is submitted that an understanding of the operation of motion detectors would be known to one of ordinary skill in the art, and therefore such description is not included in the disclosure of the present invention.

At the time a break-in, step 305 may include a motion detector 10*a* detecting movement within its perimeter of detection in the room that the motion detector 10*a* and security video camera 15*a* are located. Further in step 305, the motion detector 10*a* may then send a detection signal to the computer 5 either by wired connection or wireless connection, which may also include a bluetooth connection. Step 310, which may occur simultaneously with step 305, may include the computer 5 capturing still and video images of the room from the video security camera 15*a*, whereby the still and video images have been time-stamped at the time that detection signal is received at the computer 5 from the motion detector 10*a*.

Upon receiving the detection signal from the motion detector 10*a*, the computer 5 may then, in step 315, access the surveillance profile of the motion detector 10*a* that has been stored therein, which also may indicate, for example, that sensor 10*a* is a motion detector that is located on the second floor in the third room to the right beneath the chimney, as shown in the example of FIG. 1, and may further describe the layout and/or contents of the room.

The computer 5 may then transmit the alarm signal originating from motion detector 10*a*, the corresponding surveillance profile and the captured and time-stamped still and video images over the DSL/cable modem line 25 to the NID 30, in step 320, which may then transmit both the alarm signal and surveillance profile to the security system platform 40 on the network 35. The security system platform 40 may include intelligent database 42 that may store the registration information. Thus, step 325 may include intelligent database 42 performing a match of the received surveillance profile of all security equipment in residence 100, all of which includes the street address of residence 100, with the nearest available emergency service personnel, including police and/or private security, which was registered in step 300.

Step 330 may then include the intelligent database 42 initiating a contact protocol to contact the occupants of the residence 100 to either verify or notify them of the break-in. Thus, in step 330, the intelligent database 42 may place an automated call to a home telephone number 20 as well as, or in the alternative, sending an e-mail notification request to the IP address of computer 5, whereby the e-mail notification may include at least one of a textual alert message and an audio alert message. Both the automated telephone call and e-mail notification request may include an automated message requesting an authorized security code that has been pre-registered in the intelligent database 42 of the security system platform 42. If there is no reply to the communication initiated at step 330, the protocol proceeds to step 345, which may include the intelligent database 42 of the security system network platform 40 placing an automated call to the police or security personnel, at either of terminals 45 or 55, that are deemed to be closest to residence 100 based upon a matching of the registered location of the emergency services personnel and the received surveillance profile However, if step 335 includes an answer on the receiving end of telephone line 20 or a response at the IP address of computer 5 in response to the communication initiated at step 330, the protocol may proceed to step 340 which may include the intelligent database 42 at platform 40 checking the received security code against the pre-registered security code. If the security code received at step 343 in response to the request at step 340 matches the pre-registered security code, the security breach may be considered to be a false alarm and the emergency protocol may be terminated at step 360.

However, if the security code received at step 343 does not match the pre-registered security code, or if no security code is received at all, then the protocol may proceed to step 345, described above. The automated call to the nearest police personnel, by calling mobile terminal 45*a*, may include the surveillance profile of motion detector 10*a*, which includes the street address of the residence 100, the room location of motion detector 10*a*, time-stamped still and video images from the security video camera 15*a*, and even the physical layout of the room in which the motion detector 10*a* and security video camera 15*a* are located. Further, a call may be made to either of terminals 45 or 55, the call including a transmission to a pre-registered IP address corresponding to the respective terminals, over a DSL, cable or other high-speed, broadband connection.

Once the proper emergency services personnel, in this case the nearest police or security personnel, have been dispatched to the break-in at residence 100, the intelligent database 42 of the security system platform 40 may then resume attempts to contact the occupants of residence 100 to notify them of the emergency. Thus, in step 350, the intelligent database 42 may place automated calls to a sequence of secondary telephone numbers that have been pre-registered in the intelligent database 42 at the security system platform 40 by the security system subscriber for the residence 100. The sequence of secondary telephone numbers may be automatically dialed until either an answer is received or the list of telephone numbers is exhausted without an answer. Upon receiving an answer, an automated message may be played to the answering party at step 355. The automated message, stored in the intelligent database 42 at the security system platform 40, may indicate, for example, the type of emergency that was detected, the address of the residence, and the time that the break-in was detected. The list of secondary telephone contacts may be supplemented, or even replaced, with a list of secondary IP addresses, with the notifications being sent in the form of an automated e-mail message. The emergency protocol is then ended at step 360.

In accordance with the spirit of the present invention, the administration of a security system, as described above, may be implemented by a single network that services multiple agent platforms for multiple security service providers. Such implementation depends on capacity of the network, however. Thus, the security service providers may eliminate central monitoring stations that are vulnerable to human error, as described in the Background of the Invention, to thereby reduce costs of monitoring and further improve reliability of the security system.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

We claim:

1. A method of administering a security system, said method comprising the steps of:

receiving a surveillance profile from security equipment that has detected a security breach;

dispatching emergency services corresponding to the surveillance profile of the security equipment, wherein said step of receiving the surveillance profile from the security equipment includes receiving information identifying the detecting security equipment as at least one of a video camera, motion detector and heat detector, and further includes receiving at least one of registration information corresponding to the detecting security equipment, a location of the detecting security equipment and a physical description of the contents of a room in which the detecting security equipment is located; and upon detection of a security breach, requesting verification from a predetermined sequence of terminals corresponding to the detecting security equipment, and if a predetermined authorization code is received in response, terminating further processing associated with the received surveillance profile, including dispatching emergency services, otherwise the method further comprises, after said dispatching step, the step of informing a subscriber of the security breach by calling a sequence of designated telephone numbers until the first of (1) receiving a response by an answering party or (2) exhausting the sequence of designated telephone numbers without receiving an answer, wherein the step of requesting verification from a predetermined sequence of terminals correspondingly to the detecting security equipment includes at least one of (1) calling a designated telephone number to request the predetermined authorization code from an answer party and (2) transmitting the request for the predetermined authorization code to a designated internet protocol (IP) address for a processor corresponding to the detecting security equipment.

2. The method according to claim 1, wherein said step of receiving a surveillance profile includes receiving the surveillance profile from a processor corresponding to the detecting security equipment.

3. The method of claim 2, wherein the processor is located in a same building structure as the detecting security equipment, and wherein the processor stores the surveillance profile for all security equipment located within the same building structure.

4. The method of claim 3, wherein said step of receiving a surveillance profile includes receiving the surveillance profile from the processor corresponding to the detecting security equipment over a broadband connection via a network interface device.

5. The method of claim 4, wherein the broadband connection is either of a digital subscriber line (DSL) or a cable modem line.

6. The method of claim 1, wherein said step of receiving a a predetermined authorization code includes receiving a personal identification number (PIN) verbally using a voice recognition methodology.

7. The method of claim 1, wherein said step of receiving a predetermined authorization code includes receiving a personal identification number (PIN) verbally using at least one of a voice recognition methodology and receiving the PIN electronically using an IP methodology.

8. The method according to claim 1, wherein said step of dispatching emergency services corresponding to the surveillance profile of the detecting security equipment includes dispatching at least one of a local fire department and a local police department in accordance with information identifying the security equipment as at least one of a video camera, motion detector and heat detector.

9. A method of administrating a security system, said method comprising the steps of:

receiving tracking information of emergency services personnel;

receiving a surveillance profile from security equipment that has detected a security breach;

requesting verification from a predetermined sequence of terminals corresponding to the detecting security equipment, said requesting including at least one of dispatching a designated telephone number to request the predetermined authorization code from an answering party and transmitting the request for the predetermined authorization code to a designated internet protocol (IP) address for the computer corresponding to the detecting security equipment; and if receiving a predetermined authorization code, terminating further processing associated with the received surveillance profile, otherwise;

dispatching the emergency services personnel in accordance with the surveillance profile of the detecting security equipment and the received tracking information of emergency services personnel; and informing a subscriber of the security breach by dispatching a sequence of designated telephone numbers until the first of receiving a response by an answering party or exhausting the sequence of designated telephone numbers without receiving an answer.

10. The method of claim 9, wherein said step of receiving tracking information of the emergency services personnel includes receiving login registration information from individual emergency services personnel including those from police departments, fire departments and emergency medical technicians.

11. The method of claim 10, wherein said step of receiving tracking information of the emergency services personnel further includes receiving global positioning services (GPS) information for individual emergency services personnel including those from police departs, fire departments and emergency medical technicians.

12. The method of claim 11, wherein said step of receiving the surveillance profile from the detecting security equipment includes receiving information identifying the detecting security equipment as at least one of a video camera, motion detector and heat detector.

13. The method of claim 12, wherein said step of receiving the surveillance profile includes receiving at least one of registration information corresponding to the detecting security equipment, a location of the detecting security equipment and a physical description of the contents of a room in which the detecting security equipment is located.

14. The method of claim 13, wherein said step of receiving a surveillance profile includes receiving the surveillance profile a from a database corresponding to the detecting security equipment.

15. The method of claim 13, wherein the database includes a computer located in a same building structure as the detecting security equipment, and wherein the computer stores the surveillance profile for all security equipment located within the same building structure.

16. The method of claim 15, wherein said step of receiving a surveillance profile includes receiving the surveillance profile from the computer corresponding to the detecting security equipment over a broadband connection via a network interface device.

17. The method of claim 15, wherein the broadband connection is either of a digital subscriber line (DSL) or a cable modem line.

18. The method of claim 13, wherein said step of dispatching emergency services corresponding to the surveillance profile of the detecting security equipment includes dispatching at least one of a local fire department and a local police department in accordance with information identifying the security sensor as one of a video camera, motion detector and heat detector and the received tracking information of emergency services personnel.

19. The method of claim 9, wherein said step of receiving a predetermined authorization code includes receiving a personal identification number (PIN) verbally using a voice recognition methodology.

20. The method of claim 9, wherein said step of receiving a predetermined authorization code includes receiving a personal identification number (PIN) verbally using at least one of a voice recognition methodology and an IP methodology.

* * * * *